US005895043A

United States Patent [19]

Maier et al.

[11] Patent Number: 5,895,043

[45] Date of Patent: Apr. 20, 1999

[54] DEVICE FOR FEEDING A CONVEYING APPARATUS

[75] Inventors: Wilhelm Maier, Wettingen, Germany; Jean-Claude Oppliger, Niederhasli, Switzerland

[73] Assignee: GRAPHA-Holding AG, Hergiswil, Switzerland

[21] Appl. No.: 08/765,937

[22] PCT Filed: May 8, 1996

[86] PCT No.: PCT/CH96/00178

§ 371 Date: Jan. 14, 1997

§ 102(e) Date: Jan. 14, 1997

[87] PCT Pub. No.: WO96/36550

PCT Pub. Date: Nov. 21, 1996

[30] Foreign Application Priority Data

May 17, 1995 [CH] Switzerland ..... 01455/95

[51] Int. Cl.[6] ..... B65H 39/10

[52] U.S. Cl. ..... 271/294; 271/295; 271/225; 271/184; 198/457; 198/735.3

[58] Field of Search ..... 271/295, 294, 271/69, 287, 198, 225, 184; 198/457, 735.3; 270/58.29, 52.16

[56] References Cited

U.S. PATENT DOCUMENTS

| | | | |
|---|---|---|---|
| 3,096,089 | 7/1963 | Swenker et al. | 271/295 |
| 4,169,529 | 10/1979 | Hunter . | |
| 5,052,679 | 10/1991 | Sekino | 271/293 |
| 5,362,040 | 11/1994 | Midavaine et al. . | |
| 5,462,268 | 10/1995 | Remy et al. | 271/69 |
| 5,682,973 | 11/1997 | Holmes et al. | 271/225 |

FOREIGN PATENT DOCUMENTS

| | | | |
|---|---|---|---|
| 0084297 | 7/1983 | European Pat. Off. . | |
| 0480822 | 4/1992 | European Pat. Off. . | |
| 0608161 | 7/1994 | European Pat. Off. . | |
| 0638501 | 2/1995 | European Pat. Off. . | |
| 1929600 | 12/1970 | Germany . | |
| 404367856 | 12/1992 | Japan | 271/287 |

*Primary Examiner*—H. Grant Skaggs
*Attorney, Agent, or Firm*—Venable; George Spencer; Robert Kinberg

[57] ABSTRACT

An arrangement for feeding a conveying apparatus comprising hoppers for flat products such as envelopes, mailing pouches, workpieces and the like, which can be emptied at certain intervals and are secured on a rotatably driven traction element. A device including a slanted guide wall defining a conveying channel is located above the conveying apparatus for conveying the products in a conveying direction into a respective one of the hoppers located below the conveying channel. The device includes a size intake opening communicating with the conveying channel for receiving products into the conveying channel from a side of the device in a direction at a right angle to the conveying direction. The device further includes a rotating clearing mechanism laterally penetrating the conveying channel and operating jointly with the guide wall for conveying the products into the hoppers.

14 Claims, 1 Drawing Sheet

DEVICE FOR FEEDING A CONVEYING APPARATUS

BACKGROUND OF THE INVENTION

The invention concerns a device for feeding a conveying apparatus, having hoppers for flat products such as envelopes, mailing pouches, workpieces or the like, which can be emptied and are secured at intervals on a rotatably driven traction element.

Such a device is disclosed in EP-A-0'638'501. There, the flat products on a conveyor belt are fed individually to a hopper that is in the opened position (see in particular FIG. 9).

SUMMARY OF THE INVENTION

It is an object of the invention to create a device of the aforementioned type, which permits a reliable feeding of the hoppers with flat products of a differing thickness, format and surface.

The solution according to the invention is that a conveying channel is arranged above the conveying apparatus, which is connected to it at a product transfer point such that it conveys, has an intake opening and is formed by a stationary clearing device that is operated jointly with and fits laterally inside the conveying channel. With the device according to the invention, the products can be transported gently as well as timed.

In addition, the device according to the invention permits an approach almost without spacing to the conveying apparatus, so that the products remain in guiding contact even at the point of transfer.

BRIEF DESCRIPTION OF THE DRAWINGS

Further advantages result from the following description and the drawing, which impart an exemplary embodiment of the invention. Shown are.

DETAILED DESCRIPTION OF THE INVENTION

Figure 1:
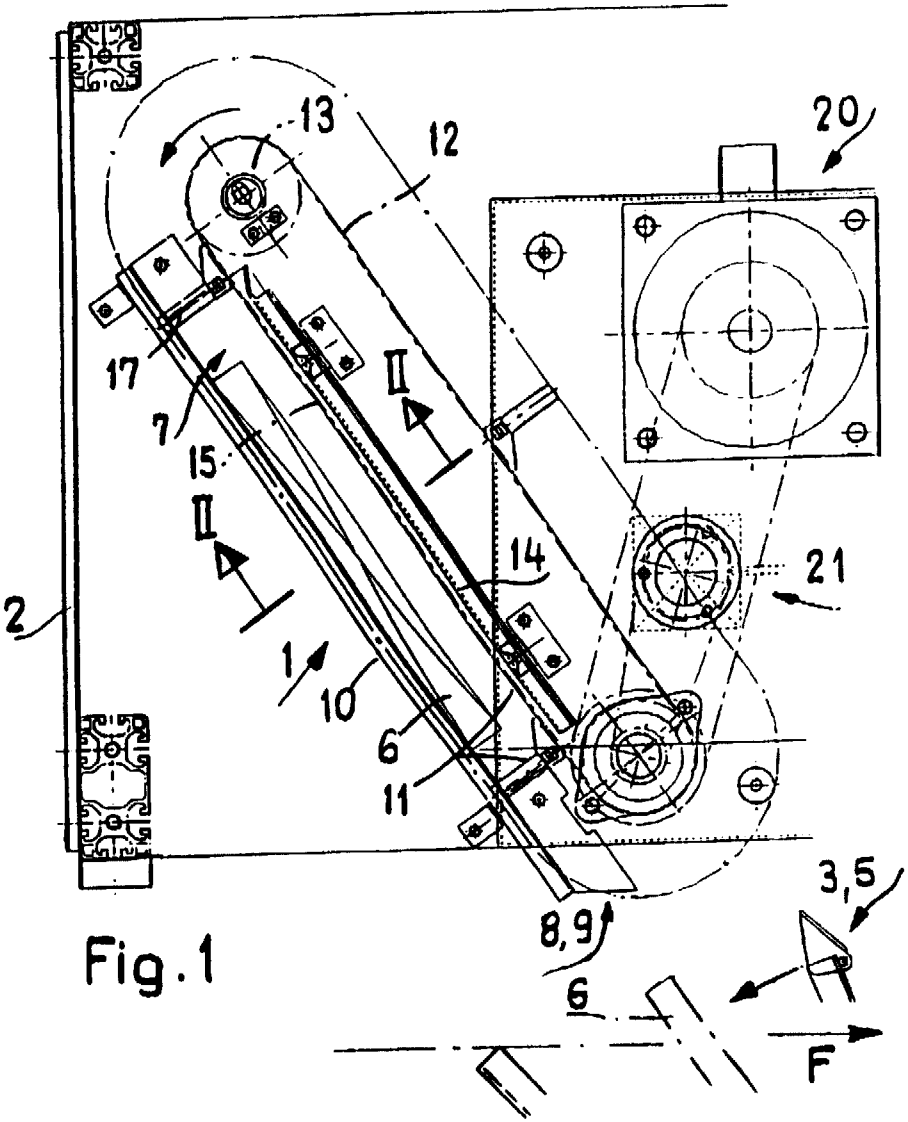
FIG. 1 A view from the side of an embodiment according to the invention.
Figure 2:
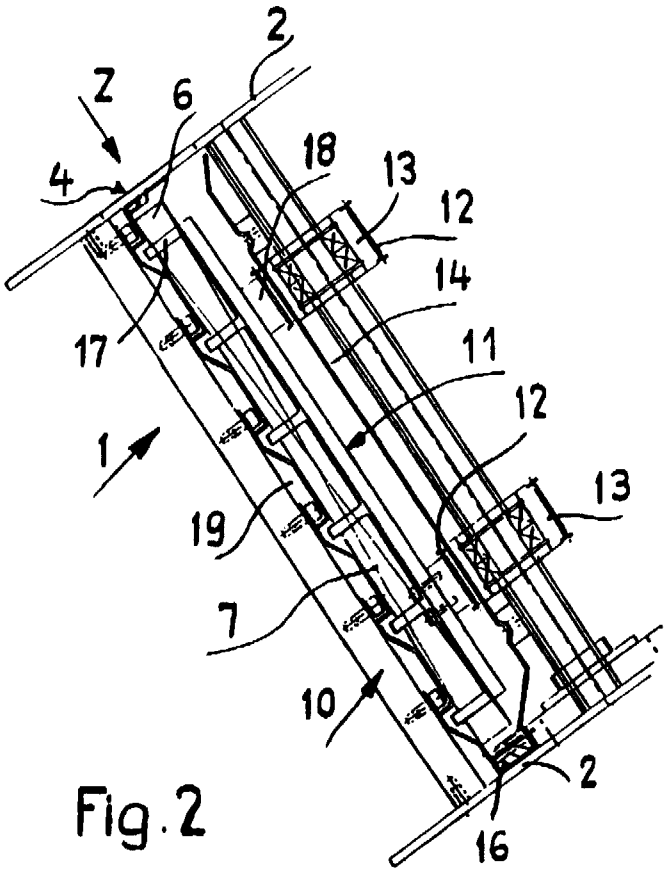
FIG. 2 A partial cross section through the embodiment according to line II—II, FIG. 1.

In accordance with FIGS. 1 and 2, the device 1 is attached to a frame 2 and serves to feed a conveying apparatus 3, of which the feed opening for hoppers 5 can be seen in FIG. 1. Arrow F corresponds to the conveying direction for the hoppers 5, which are secured to a rotatably driven traction element (not visible). A product 6 shown with dash-dot line, for example a mailing pouch, has just been fed into the hopper 5. A following product 6 is located in the conveying channel 7 of the apparatus 1, to which it has been supplied in accordance with arrow Z in FIG. 2 or perpendicular to the drawing plane in FIG. 1.

The conveying apparatus 3 and the conveying end 8 of the device 1 form a point of transfer 9, at which the products 6 are guided onto the path toward the hoppers 5.

The conveying channel 7 is composed of a stationary guide wall 10 that is attached to the frame 2 and a clearing device 11, installed laterally in the conveying channel 7 and operated jointly with it. In accordance with the drawing, this device comprises two parallel installed, endlessly circulating traction means or drive belts 12. In order to limit the conveying channel 7 with respect to height, a guide element 14 is provided behind the drive belts 12 and opposite the guide wall 10, which is connected to the frame 2 and is arranged in conveying direction between the deflection rollers 13 of drive belts 12, which has the effect of guiding or rejecting the products 6 directly beside the rear portion of the upper/lower end reaches 15 of drive belts 12 that face the conveying channel 7. The conveying channel 7 is limited on the side by means of buffer 16—which could be composed of an impact-absorbing material—located opposite the side intake opening 4 for conveying channel 7. This buffer 16 could also be formed by a driving belt for the clearing device 11 if this drive belt would rotate around axes that are positioned at a right angle to the stationary guide wall 10. The conveying channel 7 extends or is positioned to be approximately aligned with the feeding direction for the hoppers of the conveying apparatus 3, so that an uninterrupted transfer of the products 6 can take place. It means that the conveying direction of the conveying channel 7 is designed to slant downward owing to the fact that at the point of transfer 9, the position of hoppers 5 of the conveying apparatus 3 is slanted toward the back with respect to the drive direction. As a result of this, a feeding with a zipper effect between products 6 and conveying apparatus 3 develops at the point of transfer 9.

The slanted position of the conveying channel 7 favors the stabilization of the products 6 on a coplanar connection that is formed by the guide wall 10 of conveying channel 7 at the side intake opening 4 and the feeding plane that is arranged at a right angle to it. The clearing device 11 has several clearing tools attached at intervals to the two parallel arranged traction means 12, comprising a bar with clearing fingers 17 distributed across the width of conveying channel 7, wherein the spacing for the clearing tools on the traction means 12 is at least equal to the width of the intake opening 4. On the one hand, this makes it possible to use the complete opening width of the intake opening and to ensure a clear path into the hoppers. Adapters 18 are provided to connect the clearing tools to the traction means 12. In order to avoid a gap between the stationary guide wall 10 and the tips of clearing fingers 17, the first is provided with grooves 19 extending in conveying direction, into which the clearing fingers 17 extend. The clearing device 11 is operated with motor 20, via a traction means connecting gear 21.

The products 6 in the conveying channel 7 are subjected to their gravitational force and/or a short-term driving force of a rear clearing tool (as seen in conveying direction) of a pair of clearing tools that forms the receiving area following the intake opening 4. Such rear clearing tool exerts an accelerating effect on the products 6 in such a way as to develop a timed connection with the hoppers 5 of the conveying apparatus 3. The clearing tools are therefore driven preferably intermittently, in phase with the hoppers 5 that pass by the point of transfer.

A control is provided for this, which causes the acceleration and deceleration of the clearing tools for an intermittent drive.

We claim:

1. In an arrangement for feeding a conveying apparatus comprising hoppers for flat products such as envelopes, mailing pouches, workpieces and the like, which can be emptied at certain intervals and are secured on a rotatably driven traction element, the improvement comprising:

a device including a slanted guide wall defining a conveying channel located above the conveying apparatus for conveying the products in a conveying direction into a respective one of the hoppers located below the conveying channel, said device including a side intake opening communicating with the conveying channel for receiving products into the conveying channel from a side of the device in a direction at a right angle to the conveying direction, said device further including a rotating clearing mechanism laterally penetrating the conveying channel and operating jointly with the guide wall for conveying the products into the hoppers.

2. The arrangement according to claim 1, wherein the device includes a stop located at a lateral end of the conveying channel opposite the intake opening for the products supplied to the conveying channel.

3. The arrangement according to claim 1, wherein the guide wall of the conveying channel and means defining a preceding feeding plane for products fed into the side intake opening of the conveying channel form a nearly seamless guide surface.

4. The arrangement according to claim 1, wherein at a point of transfer of a product from the conveying channel into a respective hopper, the conveying direction of the conveying channel is approximately aligned with a feeding direction of the hopper.

5. The arrangement according to claim 4, wherein the position of the hoppers of the conveying apparatus is slanted backward with respect to a driving direction of the traction element at the point of transfer for products.

6. The arrangement according to claim 1, wherein the rotating clearing mechanism includes a circulating traction means, and a plurality of clearing tools arranged at intervals along the circulating traction means, each clearing tool including a bar and clearing fingers distributed on the bar laterally across the conveying channel.

7. The arrangement according to claim 6, wherein the circulating traction means is spaced a predetermined distance from the guide wall.

8. The arrangement according to claim 7, wherein a distance between two clearing tools on the rotating clearing mechanism defines a receiving area which corresponds at least to a width of the intake opening.

9. The arrangement according to claim 6, wherein the guide wall is stationary and includes at least one groove extending in the conveying direction and into which the clearing fingers extend.

10. The arrangement according to claim 1, wherein the device further includes a guide element which limits a height of the conveying channel and is arranged behind a reach of the traction means facing the conveying channel.

11. The arrangement according to claim 1, wherein the rotating clearing mechanism includes a controllable drive motor for rotating the rotating clearing mechanism in phase with the hoppers for the conveying apparatus.

12. The arrangement according to claim 11, further including a control connected to the drive motor.

13. The arrangement according to claim 11, wherein the controllable drive motor is for driving the clearing mechanism intermittently.

14. The arrangement according to claim 1, wherein a feeding segment preceding the conveying channel and a conveying segment of the conveying channel form an approximately rectangular deflection device.

* * * * *